US005377784A

United States Patent [19]

Walkowiak et al.

[11] Patent Number: 5,377,784

[45] Date of Patent: Jan. 3, 1995

[54] PASS DOOR FIRE LINTEL

[75] Inventors: Stefan Walkowiak, St. James; Stephen Petrovich, East Patchogue, both of N.Y.; Herman Reis, Brampton, Canada

[73] Assignee: The Peelle Company, Bay Shore, N.Y.

[21] Appl. No.: 118,039

[22] Filed: Sep. 8, 1993

[51] Int. Cl.[6] ..... D66B 13/00

[52] U.S. Cl. ..... 187/336; 49/120; 49/305; 187/400

[58] Field of Search ..... 187/58, 51, 98; 49/120, 49/119, 116, 303, 305, 306, 310, 312, 311, 315

[56] References Cited

U.S. PATENT DOCUMENTS

| | | | |
|---|---|---|---|
| 702,715 | 6/1902 | Fishbeck | 49/305 |
| 1,104,399 | 7/1914 | Allen | 49/305 |
| 1,709,595 | 4/1929 | Schweig | 49/95 |
| 2,300,630 | 11/1942 | Norton et al. | 187/58 |
| 3,302,334 | 2/1967 | Totland | 49/312 |

*Primary Examiner*—Kenneth W. Noland

*Attorney, Agent, or Firm*—Pearne, Gordon, McCoy & Granger

[57] ABSTRACT

A fire lintel for a freight elevator pass door that provides a fire stop in the gap between the door opening header and the upper panel of the pass door and that is displaceable for passage of the door above into the gap when the door above opens. Two embodiments of the fire lintel are characterized by overlapping baffle-like elements that afford a high resistance to the passage of gases into the hoistway in the event of a fire.

12 Claims, 6 Drawing Sheets

27
53
47
51
52
31
48
49
54
34
43
3
3
44
46
71
33
32
49
37
26
18
41
36
57
39
67
33
71
38
19

PASS DOOR FIRE LINTEL

BACKGROUND OF THE INVENTION

The invention relates to a novel fire stop for pass doors in freight elevator systems.

PRIOR ART

Biparting, vertically sliding, counterbalanced pass doors for freight elevator landings have long been known. They are used where the floor-to-floor dimension at least at one level is limited in comparison to the door opening height. The upper panel of the door at the short height landing or floor is offset behind the lower panel of the door for the floor above. This allows either the door at the short height floor to be opened upwardly or the door at the floor above the short height floor to be opened downwardly without interference between these panels. It is also known, in connection with pass doors, to provide a pivotal fire stop or lintel at the gap between the upper panel of the pass door and the top of the door opening in the wall of the landing. The fire stop which is typically carried on the upper panel of the pass door, retracts when either this panel is opened or the lower panel of the door above is opened. U.S. Pat. No. 1,709,595 to Schweig illustrates a latching type of fire stop for this service and it is known to provide similar devices with simple counterweights and without latches. These known kinds of devices employing a simple pivoting plate generally do not completely cover the gap between the pass door upper panel and the wall at the landing but, rather, are designed to leave some limited clearance for their free operation so as to account for dimensional and positional variation between the door and hoistway walls.

The described prior fire stop lintels have proven satisfactory over decades of use in service in stopping flames, smoke and flow of hot gases in the event of an actual fire. Regulatory agencies charged with fire safety matters have evolved test procedures and analyses that, in their view, indicate a desirability of the avoidance of any simple clearance in the fire stop geometry. This analyses considers, among other things, that a door may distort in the event of a fire and increase the size of any simple clearance area.

SUMMARY OF THE INVENTION

The invention provides a fire lintel that affords a complete seal across the gap between the upper panel of a pass door and the wall of the adjacent landing. The seal is established both at the upper panel of the door and at the wall forming the door opening at the floor associated with the pass door. A portion of the fire lintel seal is mounted independently of the upper panel and, in the disclosed embodiments, is displaced only when the lower panel of the door above is lowered in its opening movement.

In a first embodiment of the invention, the fire lintel includes a sheet or plate pivotally mounted on the header of the door opening. In its extended or fire stop position, the plate at its edge proximal to the pivot axis abuts the underside of the header along a distance sufficient to establish a labyrinth or baffle seal with the header in the wall. At its edge distal from the pivot axis, the lintel plate cooperates with a flange secured to the upper panel. The distal edge of the plate and the flange form a labyrinth or baffle-type fire tight seal. The plate is resiliently biased to its extended position and is pivotally displaced downwardly by the lower panel of the door above when the latter is opened. Conversely, when this lower panel is closed, the biasing force returns the plate to its extended fire stop position. The position of the plate is unaffected by movement of the upper panel of the pass door itself.

In a second embodiment of the invention, a fire lintel plate is disposed below the lower panel of the door above and is guided for vertical movement on the same guide rails as this panel. The fire lintel plate is suspended by cables supported on brackets fixed to the top of the upper panel of the pass door. The fire lintel plate is resiliently biased to an operative fire stop position by a counterweight and pulley system carried on this upper panel. When the lower panel of the door above descends upon opening movement, the fire lintel plate is pushed downwardly and the counterweight is raised to accommodate this movement. When this door panel is raised for closing movement, it is followed by the fire lintel under the influence of the counterweight. In the case of the upper panel of the pass door opening upwardly, the pulley system allows the fire lintel to stay in position relative to the lower panel of the door above while the counterweight rises with the moving panel.

DESCRIPTION OF THE PREFERRED EMBODIMENTS

Figure 1:
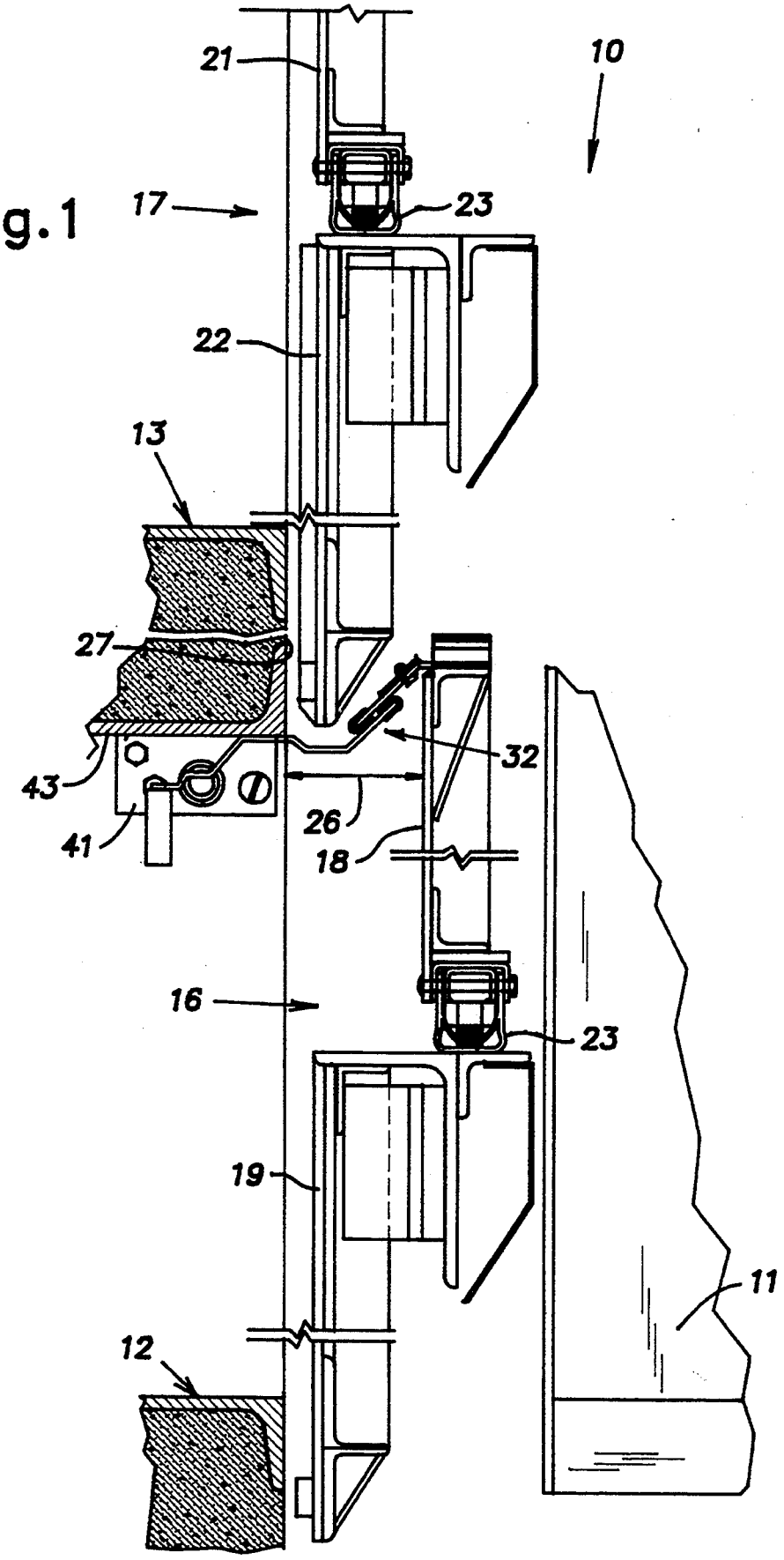
FIG. 1 is a schematic sectional elevational view of two floors or landings with a pass door at the lower floor and an extended sill door at the floor above.

Referring now to FIG. 1, there is shown a hoistway 10 for a freight elevator car schematically illustrated at 11 serving at least two landings or floors 12, 13 of a building or similar structure. For purposes of illustration, the lower landing 12 of the hoistway 10 is provided with a pass door unit 16 while the landing 13 above is provided with an extended sill door unit 17. The door units 16, 17 are vertically sliding, biparting and counterbalanced as is known in the art. Upper and lower panels of the pass door 16 are designated 18, 19 while the upper and lower panels of the extended sill door 17 are designated 21 and 22. Typically, a pass door is used where the floor-to-floor height is limited and interference between the upper panel of one door would otherwise occur with the lower panel of the door unit above where they were in the same vertical plane.

The doors 16, 17 are of generally conventional construction and operation except where, as described below, they are arranged to carry or receive the components of the fire lintel of the invention. The upper panel 18 or 21 of each door unit 16 or 17 is counterbalanced by its associated lower panel 19 or 22 in a customary manner. Each upper panel 18, 21 includes a resilient astragal 23 at its lower edge that seals on its associated lower panel 19, 22 when the panels are closed.

The upper panel 18 of the pass door 16 is set back into the hoistway 10 from the plane of the lower panel 19 of the door above 17 so that when either it is raised for opening or the lower panel above is lowered for opening, there is no interference between these panels. A gap 26 exists between the upper panel 18 of the pass door 16 and the wall, designated 27, forming part of the boundary of the hoistway 10. This gap 26 at the upper panel 18 and the wall 27 requires a stop to prevent passage of hot gases, smoke and flames in the event of a fire. The bottom of the upper panel 18 is stopped by the astragal 23 and the top of the lower panel 19. The sides of the panel 18 typically are sealed by metal shields known in the art.

A top 31 of the upper panel 18 is sealed or stopped by a fire lintel assembly 32 that includes an elongate steel plate 33 bent into an irregular, more or less Z-shaped cross-section. The plate 33 has a longitudinal edge 34 fixed to a pivot shaft 36 by screws 37 spaced along its length. At each side of the door opening, designated 38, the shaft 36 is pivotally supported by a bushing 39 received in a mounting block 41. Each block 41 is bolted or otherwise secured to a jamb of the opening 38 just below a header channel or flange 43 of the opening. The plate 33 is configured to seal against the header channel 43 with a relatively wide area of overlap in contact or near contact with the header channel so as to form a baffle-like or labyrinth seal with the header channel. At its edge 44, distal from the pivot shaft 36, the plate 33 is provided with a stiffening hem 46 of a U-shaped strip of nylon. When the doors 16 and 17 are closed, a steel flange assembly 47 overlies the distal edge 44 of the fire lintel plate 33 and thereby forms a labyrinth or baffle seal with this plate. The flange assembly 47 has a piano hinge 48 running lengthwise the width of the door 16. A steel strip 49 is welded or otherwise fixed in a fire-tight manner to one leaf of the piano hinge 48 and an angled steel mounting strip 51 is suitably welded to the other leaf. The angle strip 51 is assembled to the upper panel 18 of the door 16 in a fire-tight manner by bolts that can also hold any required fine balance weights 52 to the door. A nylon hem strip 53 reduces metal-to-metal contact noise. A metal stop 54 limits the downward hinge pivot movement of the strip 49 to the phantom position indicated in FIG. 2. The flange assembly 47 is proportioned so that the strip 49 overlies the free edge 44 of the plate 33 for a substantial distance to provide a baffle seal therewith. This overlapping seal width as in the illustrated embodiment is preferably a substantial fraction of the horizontal width of the gap 26 and can be, for example, more than one-third the horizontal width of this gap.

Figure 2:
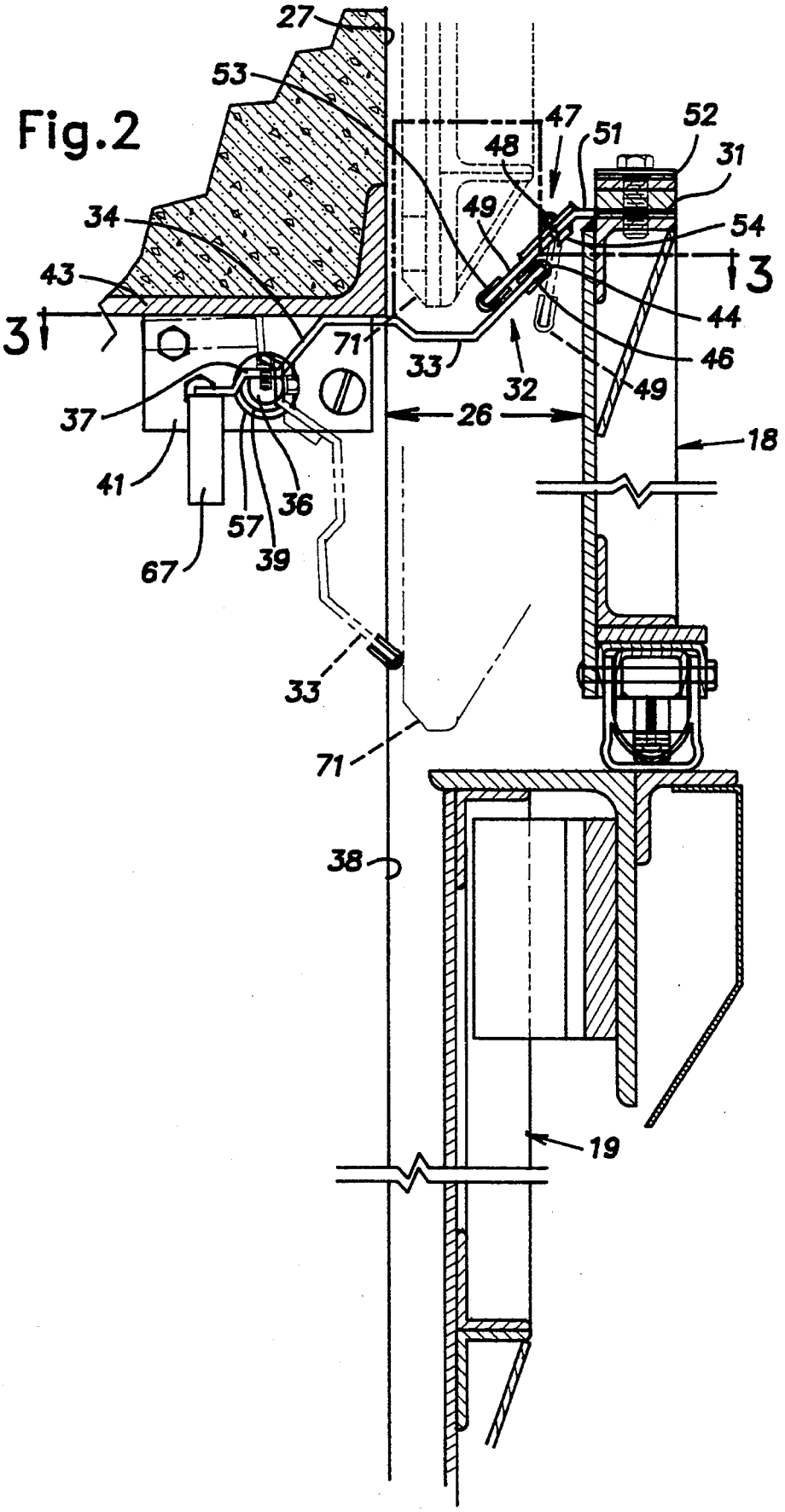
FIG. 2 is an enlarged fragmentary view similar to FIG. 1 showing details of the pass door and a first embodiment of a fire lintel constructed in accordance with the invention.
Figure 3:
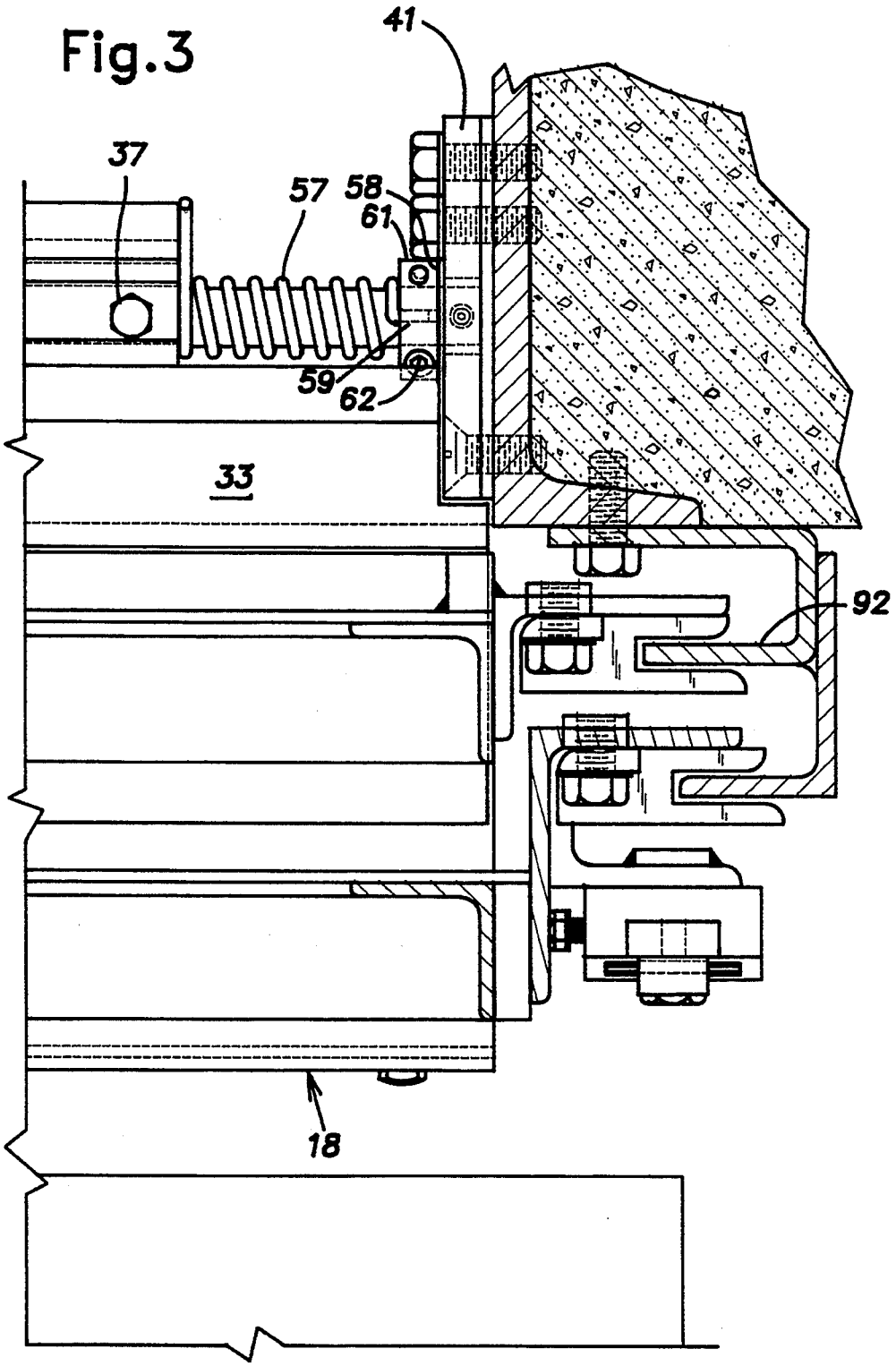
FIG. 3 is a fragmentary sectional plan view, at one side, of the fire lintel and adjacent door panels taken in the staggered plane 3—3 in FIG. 2.
Figure 5:
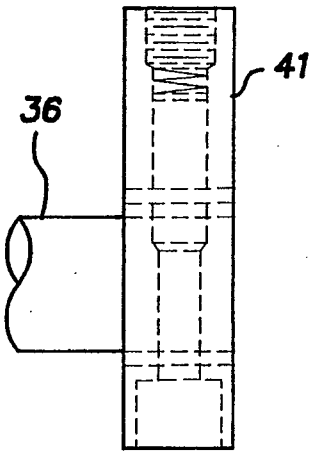
FIG. 5 is an edge view of the mounting block assembly of FIG. 4.
Figure 4:
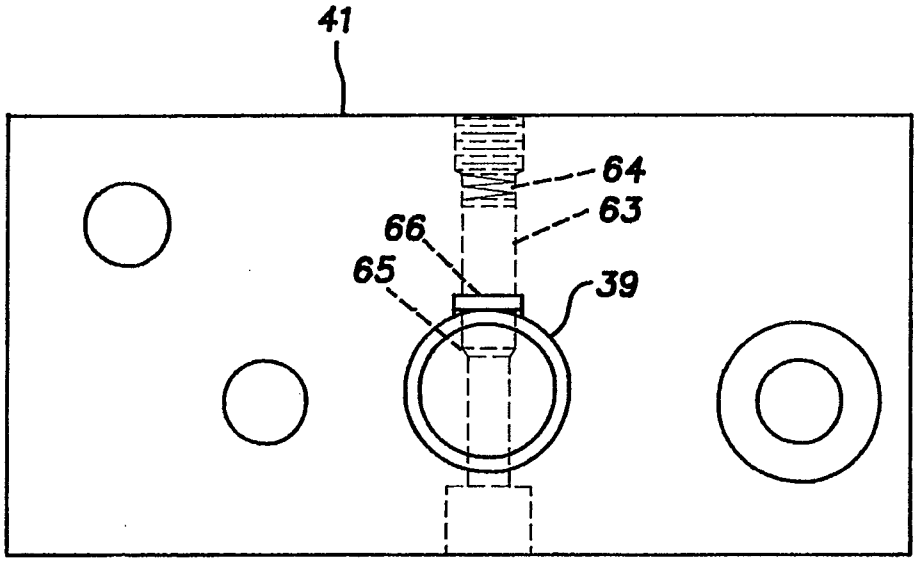
FIG. 4 is an elevational view of a typical mounting block assembly for the fire lintel of FIG. 2.

The fire lintel plate 33 is resiliently biased to the extended operative position illustrated in solid line in FIGS. 1 and 2. Means for providing a force to bias the plate 33 to its extended position are shown in two alternate or cooperative forms. A first arrangement for the extension force includes a torsion coil spring 57 assembled around the pivot shaft 36 at both of its ends. A generally tangential extension 58 of one end of the spring 57 is inserted into a retaining hole provided in the header channel 43 while an opposite end of the spring has an axial tang 59 that is received in a hole in an adjusting collar 61 assembled over the pivot shaft 36. The collar 61, which is radially split, is rotated on the shaft 36 until an adequate spring torque is developed to balance the weight of the plate 33 and the effective weight of the steel sealing strip 48. The collar 61 is then tightened and locked on the shaft 36 by means of screws 62.

Where there is concern that in the event of a fire, the heat of the fire will temper and relax the spring 57 with the risk that the plate 33 could be released downwardly, a thermally released pin 63 is provided to lock the shaft 36 and plate 33 in the extended position. A pin 63 is slidable in a radial hole in the mounting block or bracket 41 that is aligned with a diametral hole 65 in the shaft 36 when the shaft is in an angular position corresponding to the closed or extended position of the plate 33. The pin 63 is biased towards the shaft hole 65 by a compression spring 64 but is ordinarily retained out of engagement with the shaft by a thermoplastic strip 66. In the event of a fire, the strip 66 melts at a temperature below which any tempering of the torsion spring 57 occurs and releases the pin 63 into the shaft hole 65 so as to lock the shaft 36 in the extended fire stopping position of the plate 33.

As an alternative to the torsion spring 57 or as a supplement to it, a counterweight 67 is supported on the shaft 36 by a bracket generally diametrically opposite to the fire lintel plate 33. Like the coil torsion spring 57, the counterbalance 67 biases the fire stop plate 33 to its extended fire stop position.

When the pass door 16 is opened, its upper panel 18 moves upwardly. In the initial part of this movement, the steel strip 49 of the flange assembly 47 separates from the lintel fire plate 33 and at the same time pivots downwardly sufficiently to move rearwardly of the plane of the rear face of the lower panel 22 of the door 17 above. It will be understood, however, that the metal stop 54 ensures that the sealing strip 49 will extend sufficiently away from the upper panel 18 to allow it to intersect and be caught by the fire lintel plate when, eventually, the upper panel 18 is closed. During this action, it will be understood that the fire lintel plate 33 is in its extended position. At other times when the extended sill door unit 17 is opened and its lower panel 22 is correspondingly lowered, a lead or lower edge 71 of the lower panel 22 contacts the steel plate 33 and/or the steel strip 49 causing these elements to retract downwardly. Ultimately, these elements take the respective positions illustrated in phantom in FIG. 2. When the upper door 17 is closed and its lower panel 22 is accordingly raised, the steel lintel fire stop plate 33 is returned to its extended or fire stopping position by the torsion spring 57 or counterbalance 67 or both. The geometry of the steel fire stop plate 33, its pivot shaft 36 and the free or phantom position 56 of the steel strip 49 are arranged to enable the free or distal edge 44 of the plate to catch the lower edge of the steel strip 49 and return it to the solid line position illustrated in FIGS. 1 and 2.

Figure 6:
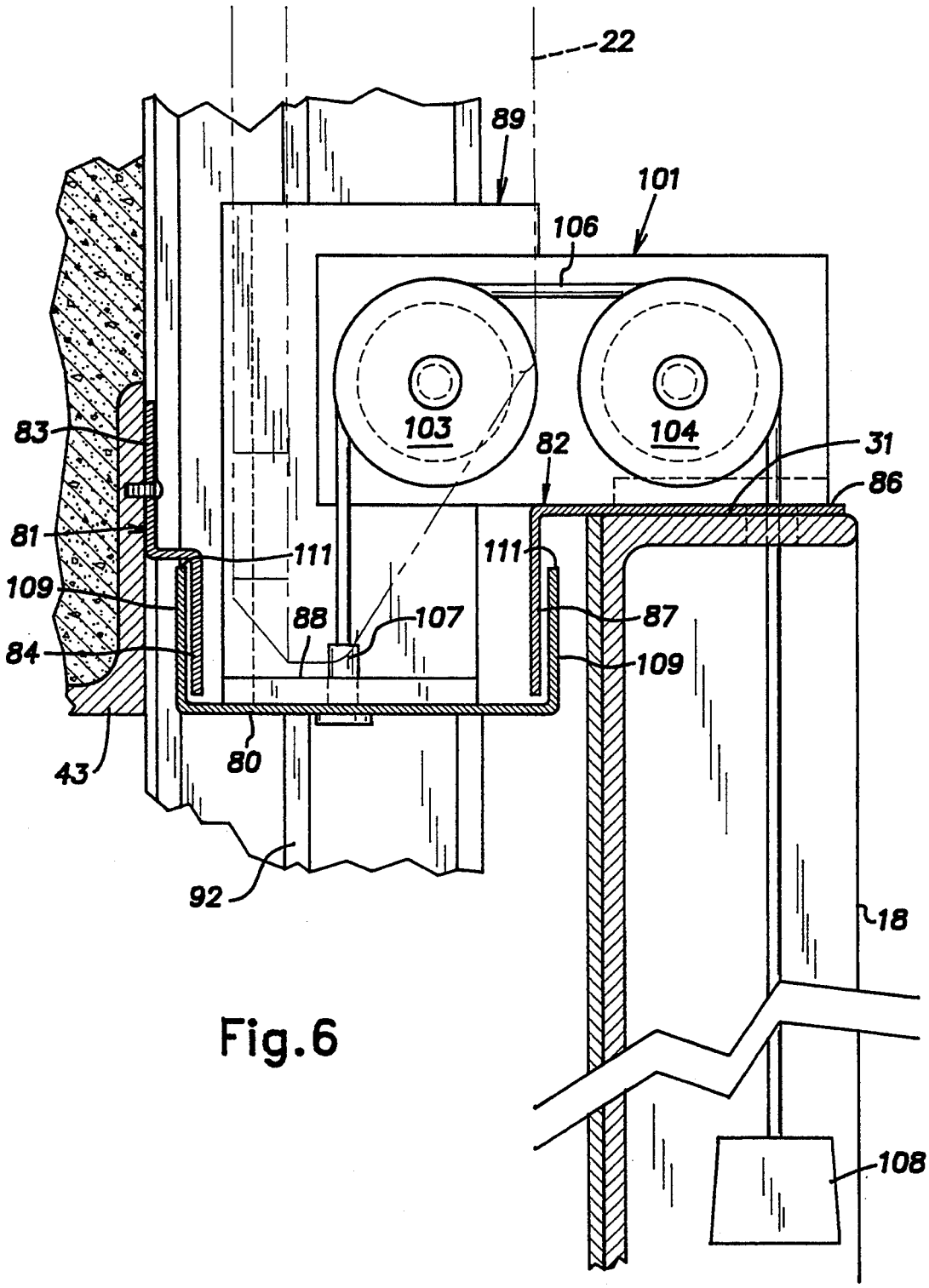
FIG. 6 is a fragmentary elevational view, partially in section, of a fire lintel constructed in accordance with a second embodiment of the invention.
Figure 7:
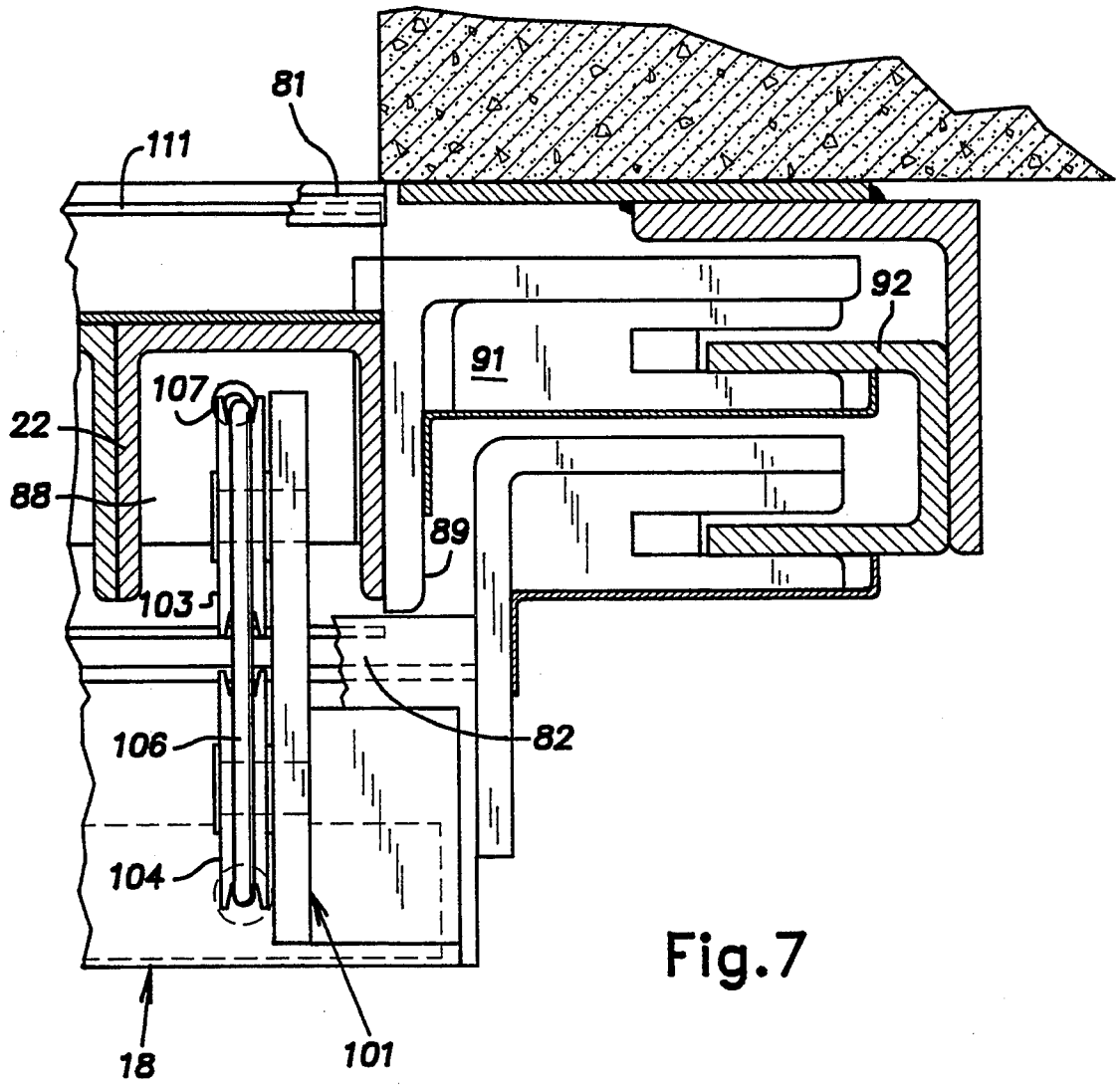
FIG. 7 is a fragmentary sectional plan view of the fire lintel of FIG. 6.

FIGS. 6 and 7 illustrate a second embodiment of the invention. Parts of the building structure and doors like those described in connection with the embodiment of FIGS. 1–5 are given like numeral designations. In this second embodiment, the fire lintel is in the form of a U-shaped steel plate 80 that cooperates with associated steel flanges 81 and 82. A first of the flanges 81 is secured by screws or other suitable fastening means to the header channel 43 in a fire-tight manner. Similarly, the second flange 82 is secured to the upper panel 18 in a fire-tight manner. The plate 80 and flanges 81, 82 extend across the full width of the door panel 18 and provide a fire stop at the top of the gap 26 between this upper panel of the pass door 16 and the header channel 43 of the associated opening 38.

The header channel flange 81 has an "S" shape or offset cross-section with a vertical upstanding portion 83 secured directly to the vertical leg of the header channel 43 and a depending vertical portion 84 spaced somewhat from the channel. The door panel flange 82 has a right angle cross-section with a horizontal leg or portion 86 positioned against the upper face 31 of the panel 18 in a fire-tight manner and a vertically depending leg or portion 87 spaced slightly from the landing side of the upper panel. The steel fire lintel plate 80 has assembled with it at each end, by welding or other suitable means, a mounting bracket 88 and a shoe angle 89. A shoe 91 of slide bearing material, known in the art, is mounted on each of the shoe angles 89 at opposite ends of the lintel plate 80. The parts are configured so that each shoe or bearing 91 can slide on the same guide track or U-channel leg 92, at opposite ends of the doors 16, 17 provided for guiding the lower panel 22 of the door above 17 in a customary manner.

Adjacent each end of the upper panel 18 is a bracket 101 that overlies, in cantilever fashion, the adjacent end of the lintel plate 80. The brackets 101 which are essentially the same except for right and left-hand symmetry, are each fixed to the upper face 31 of the upper panel. A pair of horizontally spaced pulleys or sheaves 103, 104 aligned in a common vertical plane are rotatably mounted on each bracket 101. At each end of the plate 80 a flexible strand 106 in the form of a metal cable is trained over the pulleys 103, 104 and has one of its ends anchored by a fitting 107 to the plate. An opposite end of each cable 106 is anchored to a common counterweight 108 that is disposed within the upper panel 18. The weight of the counterweight exceeds that of the fire lintel plate 80 and the other elements assembled with it including the shoe angles 89 and shoes 90.

Through the arrangement of the cables 106 and pulleys 103, 104, the counterweight 108 resiliently biases the fire lintel plate 80 upwardly to the position illustrated in FIG. 6. In this position, which is the operative fire stop position of the fire lintel plate 80, the vertical legs designated 109 of the plate 80 overlap vertical portions 84, 87 of the header channel flange 81 and the upper door panel flange 82. The overlap of these elements is sufficiently long, in the vertical direction, and sufficiently close in horizontal direction to effectively provide a labyrinth or baffle seal against flames, smoke and gases of a fire. In this regard, flow of gases is resisted because of a reversal of direction of the path which a fire at the opening 38 must flow. At areas both close to the header channel 43 and close to the upper panel 18, the only potential flow path is first up over upper edges 111 of the legs 109 of the lintel plate and then down between the legs and the closely spaced flanges 81, 82. The resistance to flame can generally be as great as deemed to be necessary by adjusting the length, i.e. overlap of the legs 109 and respective flange portions 84, 87 and narrowness of this described baffled path. As shown, each of these overlapped areas has a vertical length that is a substantial fraction of the width of the gap 26, for example, a length greater than $\frac{1}{4}$ of the width of the gap.

The cables 106 and counterweight 108 operate in two dynamic modes in positioning the fire lintel plate 80. When the pass door 16 is opened and its upper panel 18 is raised, the counterweight 108 is raised relative to the door, i.e. within the door panel, to pay out a length of cable 106 to account for an increased distance between the brackets 101 and the normal fire stop position of the fire lintel plate 80. When the upper panel 18 closes, the counterweight 108 lowers in the panel.

The other dynamic suspension mode of the lintel plate 80 occurs when the door 17 above is opened and its lower panel 22 is lowered. The lower edge 71 of this lower panel engages the fire lintel 80 and displaces it downwardly. This resulting fire lintel plate movement causes the cables 106 to lift the counterweight 108 in the pass door upper panel 18 while this panel remains stationary. When the lower panel 22 of the door above closes, the counterweight 108 descends to return the fire lintel plate 80 to its operative or fire stopping position. If desired or necessary, the biasing force provided by the counterweight 108 can alternatively be provided by a constant torque rotary spring actuator, known in the art, connected to the pulley 103 or its equivalent to tension the cables 106 and suspend the weight of the fire lintel plate assembly.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

We claim:

1. A hoistway for a freight elevator system having at least two landings with respective openings in a common wall and vertical sliding doors at said landings, a pass door unit at the lower one of said landings having counterbalanced upper and lower panels, the upper panel of the pass door unit being spaced from the wall by a gap of sufficient size to permit passage of a lower panel of the door above between it and the wall at the lower landing, fire lintel means having an operative position wherein it normally closes the gap by bridging under the lower panel of the door above from the landing to the pass door, the fire lintel means providing a baffle structure that includes mutually closely overlapping surfaces that overlap along substantially the full width of the pass door a distance that is a substantial fraction of the size of the gap, said fire lintel means being movable to a retracted position to allow passage of a lower panel of the door of the landing above the pass door landing into the gap.

2. A hoistway as set forth in claim 1, including biasing means that enables the fire lintel means to be self-restoring from its retracted position to its operative position when the lower panel of the door above is raised from said gap.

3. A hoistway as set forth in claim 1, wherein the fire lintel means includes an elongated plate extending, lengthwise, substantially across the full width of the pass door and pivot means for supporting said plate for pivotal movement between said operative position and said retracted position.

4. A hoistway as set forth in claim 3, including flange means carried on the upper panel of said pass door, said elongated plate cooperating with said flange means to provide said overlapping surfaces.

5. A hoistway as set forth in claim 2, wherein said biasing means comprises torsion spring means.

6. A hoistway as set forth in claim 3, wherein said biasing means is a counterweight.

7. A hoistway as set forth in claim 1, wherein said fire lintel means is constructed so that said mutually overlapped surfaces constrain a potential flow of gases from said lower landing to a path into said hoistway that has a substantial downward vertical component.

8. A hoistway for a freight elevator system having at least two landings with respective openings in a common wall and vertical sliding doors at said landings, a pass door unit at the lower one of said landings having counterbalanced upper and lower panels, the upper panel of the pass door unit being spaced from the wall by a gap of sufficient size to permit passage of a lower panel or the door above between it and the wall at the lower landing, fire lintel means having an operative position wherein it normally closes the gap, the fire lintel means providing a baffle structure that includes mutually closely overlapping surfaces that overlap along substantially the full width of the pass door a distance that is a substantial fraction of the size of the gap, said fire lintel means being movable to a retracted position to allow passage of a lower panel of the door of the landing above the pass door landing into the gap, and means responsive to elevated temperatures to lock said fire lintel means in its operative position.

9. A hoistway for a freight elevator system having at least two landings with respective openings in a common wall and vertical sliding doors at said landings, a mass door unit at the lower one of said landings having counterbalanced upper and lower panels panels, the upper panel of the pass door unit being spaced from the wall by a gap of sufficient size to permit passage of a lower panel of the door above between it and the wall at the lower landing, fire lintel means having an operative position wherein it normally closes the gap, the fire lintel means providing a baffle structure that includes mutually closely overlapping surfaces that overlap along substantially the full width of the pass door a distance that is a substantial fraction of the size of the gap, said fire lintel means being movable to a retracted position to allow passage of a lower panel of the door of the landing above the pass door landing into the gap, and guide rails at each side of said hoistway for guiding the lower panel of the door above for vertical movement, said fire lintel means comprising a sheet metal plate extending across said gap, and slide means for permitting said plate to be guided in translatory movement by said guide rails from said operative position to said retracted position.

10. A hoistway as set forth in claim 9, including biasing means for applying a force on said plate in an upward direction with a magnitude sufficient to lift the plate from the retracted position to the operative position.

11. A hoistway as set forth in claim 10, wherein said biasing means comprises a counterweight carried on said upper panel of said pass door.

12. A hoistway as set forth in claim 9, wherein said plate has a U-shaped cross-section with vertical legs and said fire lintel means includes a flange element fixed to said wall and a flange element fixed to said upper panel of said pass door, the vertical legs of said plate each cooperating with one of said flange elements to form a baffle restriction to gas flow.

* * * * *